US010047682B2

(12) United States Patent
Frieden

(10) Patent No.: US 10,047,682 B2
(45) Date of Patent: Aug. 14, 2018

(54) DEVICE FOR OPERATING AN INTERNAL-COMBUSTION ENGINE OF A MOTOR VEHICLE

(71) Applicant: Bayerische Motoren Werke Aktiengesellschaft, Munich (DE)

(72) Inventor: Jochen Frieden, Deisenhofen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/625,053

(22) Filed: Jun. 16, 2017

(65) Prior Publication Data

US 2017/0363019 A1 Dec. 21, 2017

(30) Foreign Application Priority Data

Jun. 17, 2016 (DE) ..... 10 2016 210 860

(51) Int. Cl.
*F02D 11/02* (2006.01)
*F02D 11/10* (2006.01)
*F02D 41/14* (2006.01)

(52) U.S. Cl.
CPC ..... *F02D 11/02* (2013.01); *F02D 11/10* (2013.01); *F02D 11/105* (2013.01); *F02D 41/1401* (2013.01); *F02D 2200/602* (2013.01)

(58) Field of Classification Search
CPC ..... F02D 11/02; F02D 11/105; F02D 11/102; F02D 41/1401; F02D 2200/602
USPC ..... 701/110
See application file for complete search history.

(56) References Cited

U.S. PATENT DOCUMENTS 4,671,235 A * 6/1987 Hosaka ..... B60K 31/107 123/352
2005/0251319 A1 11/2005 Feder et al.
2007/0271026 A1 11/2007 Hijikata
2008/0162012 A1 7/2008 Masuda et al.
2012/0078467 A1 3/2012 Schweikl et al.
(Continued)

FOREIGN PATENT DOCUMENTS

DE 102 54 595 A1 6/2004
DE 10 2004 022 554 B3 11/2005
DE 10 2007 016 632 A1 10/2007
(Continued)

OTHER PUBLICATIONS

German-language Search Report issued in counterpart German Application No. 10 2016 210 860.3 dated Nov. 3, 2016 with partial English translation (Twelve (12) pages).

*Primary Examiner* — Mahmoud Gimie
(74) *Attorney, Agent, or Firm* — Crowell & Moring LLP

(57) ABSTRACT

A device is provided for operating an internal-combustion engine of a motor vehicle having a power actuator and a control unit. The control unit is configured for adjusting the power actuator as a function of a load demand on the basis of a displacement of the driving pedal by the driver, wherein, during an efficiency mode demanded and activated by the driver, independently of the displacement of the driving pedal, a rotational-speed-dependent consumption-optimal first load demand, and as a function of the displacement of the driving pedal, a second load demand, are determined. The control unit is configured for adjusting the power actuator while taking into account the determined first and second load demands.

10 Claims, 1 Drawing Sheet

(56) References Cited

U.S. PATENT DOCUMENTS

2014/0081559 A1* 3/2014 Kar ..... F02D 13/0219
701/110

FOREIGN PATENT DOCUMENTS

DE 10 2007 023 570 A1 11/2007
DE 10 2010 041 537 A1 3/2012
DE 10 2013 222 265 A1 4/2015

* cited by examiner

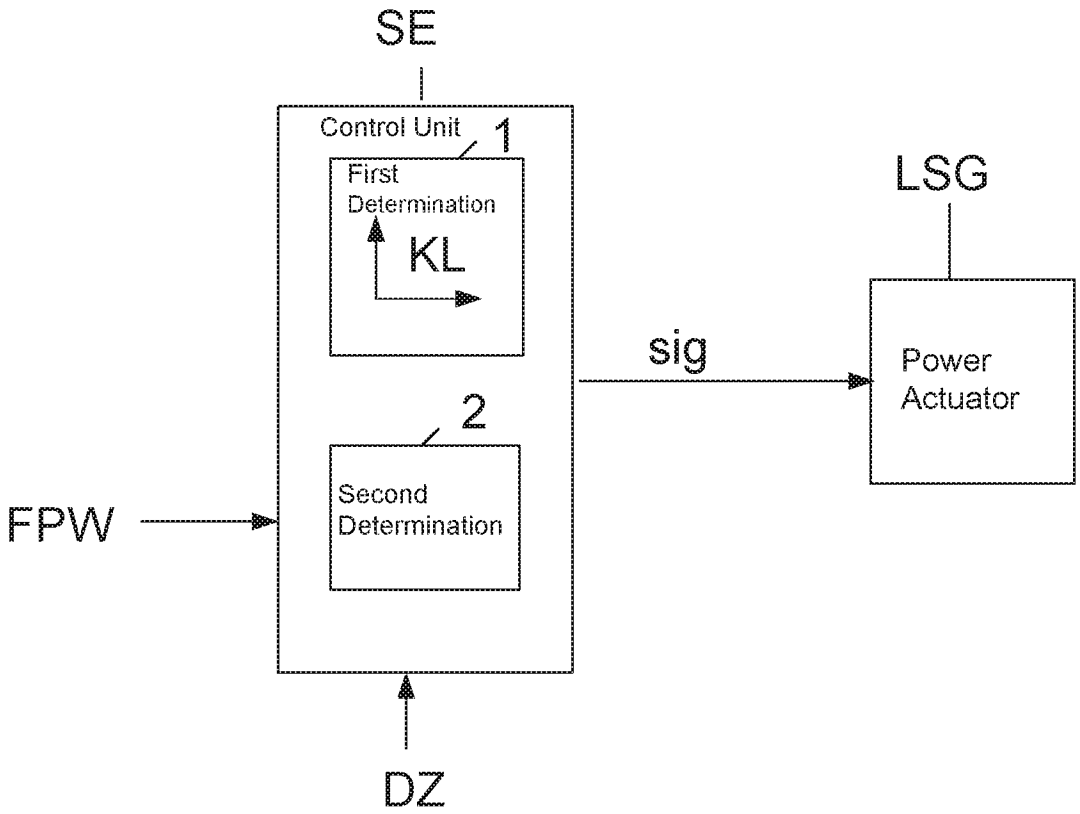
SE
Control Unit
1
First Determination
KL
2
Second Determination
FPW
DZ
sig
LSG
Power Actuator

DEVICE FOR OPERATING AN INTERNAL-COMBUSTION ENGINE OF A MOTOR VEHICLE

CROSS REFERENCE TO RELATED APPLICATION

This application claims priority under 35 U.S.C. § 119 from German Patent Application No. 10 2016 210 860.3, filed Jun. 17, 2016, the entire disclosure of which is herein expressly incorporated by reference.

BACKGROUND AND SUMMARY OF THE INVENTION

The invention relates to a device for operating an internal-combustion engine of a motor vehicle having a power actuator and a control unit, which adjusts the power actuator as a function of a load demand on the basis of a displacement of a driving pedal by the driver. The invention also relates to a correspondingly developed method.

In most motor vehicles driven by internal-combustion engines, the control of the load demand currently takes place by means of electronic pedal value sensors, among other devices, which transfer information concerning the driving pedal (also known as an accelerator or gas pedal) angle to a control device which then correspondingly actuates the throttle valve according to the driving pedal angle.

Furthermore, the driver can generally not easily recognize which driving pedal position results in a consumption-optimal or efficient acceleration during an acceleration operation. If the driver wants to make the acceleration operation efficient, he can only carry out the driving pedal actuation by instinct, in which case, however, different driving pedal positions would be required depending on the actual engine running speed.

From German patent document 10 2013 222 265 A1, a method is known for imparting haptic information in the form of a counterforce, that can be generated, upon the driving pedal. In this case, a counterforce is exerted upon the driving pedal when the torque demanded by the driver by moving the driving pedal is outside an optimal torque range. The counterforce is reduced when the torque demanded by the driver by moving the driving pedal is within the optimal torque range.

From German patent document DE 10 2010 041 537 A1, a driver assistance system is known for assisting the driver for the consumption-controlled driving by way of haptic and optical acknowledgement functions. In this case, when an eco-friendly driving mode is selected, on the one hand, a modified characteristic driving pedal curve and, on the other hand, eco-tips for the interactive output of efficient driving instructions have priority.

Finally, German patent document DE 102 54 595 A1 discloses a method of operating an internal-combustion engine, in which case, for a predefined period of time, the throttle valve angle is limited to a predefined value below a maximal throttle valve angle while the opening is maximal, if the driving pedal is completely operated at a predefined speed.

It is an object of the invention to provide an improved device and a corresponding method for the consumption-optimal operation of an internal-combustion engine when this is desired by the driver.

This and other objects are achieved by a device and a corresponding method in accordance with embodiments of the invention.

It is the basic idea of the invention to appropriately assist the driver during a desired consumption-optimal driving mode.

According to a first aspect of the invention, the device for operating an internal-combustion engine of a motor vehicle having a power actuator, particularly a power actuator in the form of a throttle valve, comprises a control unit which is configured for adjusting the power actuator at least in the normal operating mode as a function of a load demand determined on the basis of a displacement of the driving pedal, wherein, however, during an efficiency mode demanded by the driver and subsequently activated, independently of the displacement of the driving pedal, a rotational-speed-dependent consumption-optimal first load demand, and, as a function of the displacement of the driving pedal, a second load demand are determined. The control unit is configured for adjusting the power actuator while taking into account the determined first and second load demand.

Advantageously, the rotational-speed-dependent first load demand can be determined by way of an existing characteristic curve, the existing characteristic curve providing a value for a consumption-optimal load demand for any (conceivable) rotational speed or for defined rotational speed ranges of the engine.

Advantageously, the control unit may be further developed for adjusting the power actuator during an efficiency mode demanded and activated by the driver such that, as a function of the first and second load demand, the smaller of the two load demands is implemented or reached. In other words, accordingly, the second load demand made by the driver by operating the driving pedal will only not be implemented or limited if the rotational-speed-dependent consumption-optimal first load demand determined independently of the displacement of the driving pedal is smaller than the first load demand, i.e. the load demand corresponding to the driving pedal position is replaced by the respective value of the characteristic curve, as long as desired by the driver, and the load demand is above the value of the characteristic curve as a result of the position of the driving pedal.

The determination of the driver's intention with respect to operating the vehicle in the efficiency mode can take place in different fashions. In principle, it is advantageously defined that, during the starting of the engine, the vehicle is first operated in a normal mode unless the driver actively demands another operating mode. In order to permit the demand to be as easy and comfortable as possible, it may be provided that the efficiency mode can be demanded by way of a predefined or defined time-related driving-pedal actuation sequence, which can be implemented by the driver. In a particularly advantageous further development of the invention, it may be provided that the driver can demand or activate the efficiency mode by carrying out the following actions.

The driver has to first displace the driving pedal to the end position or at least almost to the end position (for example, by a displacement of at least 95% or 100%). Subsequently, particularly within a defined short time interval of, for example, one (1) second, the driver has to take back the displacement by more than a defined displacement differential value or displacement differential angle (for example, approximately 20 percent) or fall again below a defined displacement angle of, for example, 80 percent. In this case, the defined time interval will start as soon as the end position (or in the case of a corresponding default, almost the end position) is reached or left again, thus when the driver takes the displacement of the driving pedal back again. Likewise, in addition, the restriction can be provided that, in the case of the second step (taking back of the displacement), the driving pedal however, has to be further displaced by more than a defined minimum displacement angle.

When the efficiency operation is demanded, it will be activated when no efficiency operation prevention conditions are met. This may, for example, be a basic (driver) deactivation of this operating mode in the central menu or the recognition of a traffic situation in which the activating of an efficiency operation does not appear meaningful (for example, the driver is starting a passing maneuver on a federal highway or an ordinary road).

When the efficiency operation is activated, the latter will advantageously be active for at least a specified time duration (for example, 5 seconds, 3 seconds, 1 second or 0.5 seconds). In particular, the efficiency operation (after the elapsing of the specified time period) will be active until the second load demand made on the basis of the actuation of the driving pedal is smaller than the consumption-optimal first load demand determined independently of the displacement. As an alternative, the efficiency operation may also only be terminated when the second load demand is several times (or for a definable time interval) smaller than the consumption-optimized first load demand. A recognition of the driver's intention to initiate the efficiency operation can then take place only if the correspondingly required operating action for demanding the efficiency mode (for example, a slight taking-back of an (almost) fully displaced driving pedal) had not already been started while the previously demanded efficiency operating mode was still active.

A second aspect of the invention relates to a method of operating an internal-combustion engine of a motor vehicle having a power actuator (in the form of a throttle valve), wherein an engine control unit adjusts the power actuator at least in the normal mode as a function of a load demand on the basis of a displacement of the driving pedal by the driver. According to the invention, during an efficiency mode demanded by the driver and then activated, a rotational-speed dependent consumption-optimal first load demand is determined independently of the displacement of the driving pedal, and, as a function of the displacement of the driving pedal, a second load demand is determined. Subsequently, the engine control unit adjusts the power actuator while taking into account the determined first and second load demand.

The above statements concerning the device according to the first aspect of the invention correspondingly apply also to the method according to the second aspect of the invention. The method according to the invention as well as its advantageous embodiments can be carried out via an executed algorithm or a corresponding assembly arrangement in a control unit provided for this purpose.

Other objects, advantages and novel features of the present invention will become apparent from the following detailed description of one or more preferred embodiments when considered in conjunction with the accompanying drawing.

BRIEF DESCRIPTION OF THE DRAWING

The single FIG. 1 illustrates an example of the construction of a device for operating an internal-combustion engine of a motor vehicle according to an embodiment of the invention.

DETAILED DESCRIPTION OF THE DRAWING

FIG. 1 is a detailed view of a control unit SE as a central element of the device for operating an internal-combustion engine of a motor vehicle with a power actuator LSG in the form of a throttle valve. The control unit SE is constructed for adjusting the power actuator LSG as a function of a determined load demand by emitting a signal sig.

For this purpose, the control unit SE is connected with a unit (not shown here) that supplies a signal concerning the driving pedal angle FPW adjusted when the driving pedal is actuated. The unit may be an electronic pedal value sensor, which transmits information concerning the angle FPW, up to which the driving pedal is actuated, to the control unit SE. The control unit SE further receives a signal concerning the current engine rotational speed DZ. As an alternative, the rotational speed DZ—if present—may also be made available on the pedal value sensor of the driving pedal, for example, via CAN bus communication.

The control unit SE is further developed as follows. By way of the actuation of the driving pedal, which is known from the transmitted driving pedal angle FPW, the control unit SE first determines whether the driver is demanding an efficiency mode. An efficiency mode demand is known, for example, when the driving pedal is at first fully displaced and, subsequently, the driving pedal angle FPW falls below an applicable angle (for example, 90%, 80%) within an applicable time period. In this case, the time period begins at the point in time as of which the 100% actuation has been reached or is left. As soon as an efficiency mode demand can be recognized, and the efficiency mode can be initiated, a change to the efficiency mode will take place at least for a predefined time period.

As long as no efficiency mode demand has been recognized (and the vehicle is in the normal mode), the activation of the power actuator LSG will take place on the basis of the actual driving pedal angle FPW.

While the efficiency mode is activated, a rotational-speed-dependent consumption-optimal first load demand is determined in a first determination unit 1 independently of the displacement of the driving pedal while taking into account the rotational speed DZ by use of a characteristic curve KL. And, in a second determination unit 2, a second load demand is determined as a function of the displacement of the driving pedal.

If the determined consumption-optimal first load demand is less than the determined second load demand that is dependent on the driving pedal displacement, the control unit SE will send a signal sig to the power actuator LSG such that the determined first load demand is implemented or reached.

If the determined consumption-optimal first load demand is not less than or is even larger than the determined second load demand that is dependent on the driving pedal displacement, the determined second load demand is used as the basis for the activation of the power actuator LSG, i.e. the control unit SE sends a signal sig to the power actuator LSG such that the determined second load demand is implemented or reached. Simultaneously, it is examined whether the predefined time period for which the efficiency mode is at least active, has already been exceeded. If this is so, the efficiency mode will be terminated and a change will take place to the normal mode or the previously active operating mode. If the time period has not yet been exceeded, the efficiency mode will be maintained.

The invention described here considerably benefits the customer as a result of an easy activation of an efficiency mode and by the facilitated implementation of consumption-optimized acceleration operations.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for operating an internal-combustion engine of a motor vehicle having a power actuator, the device comprising:

a control unit that adjusts the power actuator as a function of a load demand based on a displacement of a driving pedal by a driver of the motor vehicle, wherein during an efficiency mode of operation demanded and activated by the driver, the control unit determines:

(a) a rotational-speed-dependent consumption-optimal first load demand independently of a displacement of the driving pedal, and (b) a second load demand as a function of the displacement of the driving pedal; and Wherein the control unit adjusts the power actuator by factoring into account the determined first and second load demands.

2. The device according to claim 1, wherein the first load demand is determined via a characteristic curve.

3. The device according to claim 1, wherein during the efficiency mode demanded and actuated by the driver, the control unit adjusts the power actuator such that, as a function of the first and the second load demands, a smaller of the first and the second load demands is implemented.

4. The device according to claim 1, wherein the efficiency mode is demanded by the driver via a defined driving pedal actuation sequence.

5. The device according to claim 4, wherein the efficiency mode is demanded by the driver via the defined driving pedal actuation sequence as follows:

(a) a first displacing of the driving pedal to an end position or at least almost to the end position, and (b) a subsequent falling below of the first displacement of the driving pedal by more than a defined displacement differential value.

6. The device according to claim 5, wherein the subsequent falling below of the first displacement of the driving pedal by more than the defined displacement differential value requires that the falling below occur within a defined time interval, the time interval beginning with the first displacing of the driving pedal to the end position or the at least almost end position.

7. The device according to claim 1, wherein the control unit maintains the activated efficiency mode at least for a predefined time period from the beginning of the demand for the activated efficiency mode.

8. The device according to claim 1, wherein the activated efficiency mode remains active until a second power demand made by the driver as a result of actuating the driving pedal is less than the rotational-speed-dependent consumption-optimal first load demand.

9. The device according to claim 1, wherein the activated efficiency mode after elapsing of a predefined time period, remains active until a second power demand made by the driver as a result of actuating the driving pedal is less than the rotational-speed-dependent consumption-optimal first load demand.

10. A method of operating an internal-combustion engine of a motor vehicle having a power actuator, the method comprising the acts of:

adjusting, via an engine control unit, the power actuator as a function of a load demand based on a displacement of a driving pedal by a driver of the motor vehicle, wherein during an efficiency mode demanded and activated by the driver, the control unit determines (i) a rotational-speed-dependent consumption-optimal first load demand independently of a displacement of the driving pedal, and (ii) a second load demand as a function of the displacement of the driving pedal; and adjusts the power actuator while factoring into account the determined first and second load demands.

* * * * *